US011229916B2

(12) United States Patent
Williamsson et al.

(10) Patent No.: US 11,229,916 B2
(45) Date of Patent: Jan. 25, 2022

(54) METHOD AND SYSTEM FOR DATA CAPTURE FOR ELECTROSTATIC PRECIPITATOR CONTROL

(71) Applicant: General Electric Technology GmbH, Baden (CH)

(72) Inventors: Carl Marcus Williamsson, Ljungby (SE); Niraj Kumar Singh, West Bengal (IN); Nanda Kishore Dash, Bhubaneswar Odisha (IN); Robert Frederick Murphy, Wethersfield, CT (US)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 655 days.

(21) Appl. No.: 16/060,541

(22) PCT Filed: Dec. 10, 2015

(86) PCT No.: PCT/US2015/064971
§ 371 (c)(1),
(2) Date: Jun. 8, 2018

(87) PCT Pub. No.: WO2017/099776
PCT Pub. Date: Jun. 15, 2017

(65) Prior Publication Data

US 2018/0361399 A1 Dec. 20, 2018

(51) Int. Cl.
*B03C 3/68* (2006.01)
*B03C 3/76* (2006.01)
*B03C 3/40* (2006.01)

(52) U.S. Cl.
CPC ..... *B03C 3/68* (2013.01); *B03C 3/40* (2013.01); *B03C 3/763* (2013.01)

(58) Field of Classification Search
CPC combination set(s) only.
See application file for complete search history.

(56) References Cited

U.S. PATENT DOCUMENTS 3,893,828 A * 7/1975 Archer ..... B03C 3/68 96/19
4,255,775 A * 3/1981 Andrews ..... B03C 3/72 361/153

(Continued)

OTHER PUBLICATIONS

Conference Proceeding-Electrostatic precipitator diagnostics based on flashover characteristics; Grass, N; Fourtieth IAS Annual Meeting. Conference Record of the 2005 Industry Applications Conference, 2005, 2005, vol. 4, p. 2573-2577 (Year: 2005).*

(Continued)

*Primary Examiner* — Frank M Lawrence, Jr.
*Assistant Examiner* — Sonji Turner
(74) *Attorney, Agent, or Firm* — Grogan, Tuccillo & Vanderleeden, LLP

(57) ABSTRACT

A system for controlling an electrostatic precipitator includes a computer control system with a computer and a controller in operative communication with an electrostatic precipitator. The computer control system is operative to control performance of the electrostatic precipitator by controlling one or more of: a) a power supply that controls voltage between an electrically grounded vertical plate and a metallic wire electrode in the electrostatic precipitator; b) a first feeder valve and a second feeder valve in a hopper; and c) a power supply to an electrical coil in operative communication with a rapper.

17 Claims, 4 Drawing Sheets

(56) References Cited

U.S. PATENT DOCUMENTS 4,624,685 A * 11/1986 Lueckenotte ..... B03C 3/66 323/903
4,928,456 A * 5/1990 Del Gatto ..... B03C 3/763 377/43
5,015,267 A * 5/1991 Del Gatto ..... B03C 3/763 95/2
5,114,442 A * 5/1992 Artz ..... B03C 3/763 323/903
5,173,867 A * 12/1992 Johnston ..... B03C 3/763 700/275
6,937,455 B2 * 8/2005 Krichtafovitch ..... B03C 3/68 361/230
7,452,403 B2 * 11/2008 Younsi ..... B03C 3/08 323/903
8,328,902 B2 * 12/2012 Boyden ..... B03C 3/763 95/5
2004/0004797 A1 1/2004 Krichtafovitch et al.
2007/0151446 A1 7/2007 Younsi et al.
2010/0037767 A1 2/2010 Boyden et al.

OTHER PUBLICATIONS

Grass, N., "Electrostatic precipitator diagnostics based on flashover characteristics," Conference Record of the 2005 Industry Applications Conference, vol. 4, pp. 2573-2577 (Oct. 2, 2005).
Parker, K., "Modern mains frequency energisation and control," Electrical Operation of Electrostatic Precipitators, pp. 119-146 (Jan. 2003).
International Search Report and Written Opinion issued in connection with corresponding PCT Application No. PCT/US2015/064971 dated Aug. 9, 2016.
International Preliminary Report on Patentability issued in connection with corresponding PCT Application No. PCT/US2015/064971 dated Jun. 12, 2018.

* cited by examiner

METHOD AND SYSTEM FOR DATA CAPTURE FOR ELECTROSTATIC PRECIPITATOR CONTROL

TECHNICAL FIELD

Disclosed herein is a method and a system for data capture for electrostatic precipitator control.

BACKGROUND

Electrostatic precipitators are systems for collecting particulate matter present in a flue gas stream generated by the combustion of a carbonaceous fuel in a power plant, which operates by virtue of a movement of charged particles immersed in an electric field. With reference to FIG. 1, the electrostatic precipitator 10 includes a series of electrically grounded vertical plates 2 between which metallic wire electrodes 4 of a few millimeters in diameter are placed and maintained at a high negative potential with respect to the plates. The flue gas stream 6 generated by the combustion of carbonaceous fuel is discharged to the electrostatic precipitator 10 and travels from the metallic wire electrodes 4 towards the electrically grounded vertical plates 2. An applied voltage of several thousand volts is applied between the metallic wire electrodes 4 and the electrically grounded vertical plates 2, which causes a corona discharge that ionizes the flue gas stream 6 around the metallic wire electrodes 4. The generated ions adhere to the particulate matter present in the flue gas stream 6, thereby charging the particulate matter causing the particulate matter to migrate towards the electrically grounded vertical plates 2. The particulate matter builds up on the electrically grounded vertical plates 2 forming a layer of particulate matter on the vertical plates. A rapper system 12 for shaking the electrically grounded vertical plates 2 causes, at regular intervals, the collected layer of particulate matter to fall into a hopper (not shown) located below the electrically grounded vertical plates 2. The flue gas stream 6 now devoid of particulate matter passes through to a stack (not shown) and is discharged to the atmosphere.

In general, a regulation system (not shown) is in operative communication with the electrostatic precipitator 10 to maintain the desired levels of voltage and/or current during operation thereof. It is customary for the metallic wire electrodes 4 of the electrostatic precipitator 10 to be powered at the highest voltage practicable in order to achieve maximum electric field strength between the metallic wire electrodes 4 and the particulate matter collecting electrically grounded vertical plates 2. Power control techniques for the electrostatic precipitator 10 have heretofore been primarily concerned with providing a rapid response to "sparking conditions", so that power to the electrostatic precipitator 10 can be "shut OFF" or reduced to a level below sparking conditions promptly after the occurrence of a spark, and at a later point in time "turned ON" or increased, in an embodiment in a "fast ramp" manner to reach a predetermined level below a selected voltage control value, in a matter of milliseconds after occurrence of the spark.

However, this power control technique is not adequate to address the occurrence of sparking in an electrostatic precipitator 10 for sparking prediction, prevention and/or control. Accordingly, a method and a system operable to detect sparking conditions, i.e., conditions that directly or indirectly cause sparking, and to control voltage, current and/or power to the electrostatic precipitator to prevent or minimize the number of sparking occurrences and/or to reduce electrostatic precipitator downtime resulting from sparking occurrences is desirable.

SUMMARY

Disclosed herein is a system 200 for controlling an electrostatic precipitator 100 comprising a computer control system 215 that comprises a computer 220 and a controller 210 in operative communication with the electrostatic precipitator 100. The computer control system 215 is operative to control performance of the electrostatic precipitator 100 by controlling one or more of: a) a power supply 105 that controls voltage between an electrically grounded vertical plate 102 and a metallic wire electrode 104 in the electrostatic precipitator 100; b) a first feeder valve 122 and a second feeder valve 124 in a hopper 116; and c) a power supply to an electrical coil 423 that is in operative communication with a rapper 112.

Disclosed herein too is a method for controlling the electrostatic precipitator 100 comprising transmitting a signal from an electrostatic precipitator 100, a measuring device 118 for determining flue gas particulate matter content; a rapper system 400, and a hopper 116 associated with the electrostatic precipitator 100, to the computer control system 215. The computer control system 215 comprises a computer 220 and a controller 210. The computer 220 is operable for use of predetermined programmed measurement data, use of collected historical data capture and/or for correlating data captured from system 200, and for transmitting a signal from the computer 220 to the controller 210. Upon receipt of the transmitted signal, the controller 210 is operative to effect a change in functioning of the electrostatic precipitator 100 based on the signal received from the computer 220.

DETAILED DESCRIPTION

Figure 1:
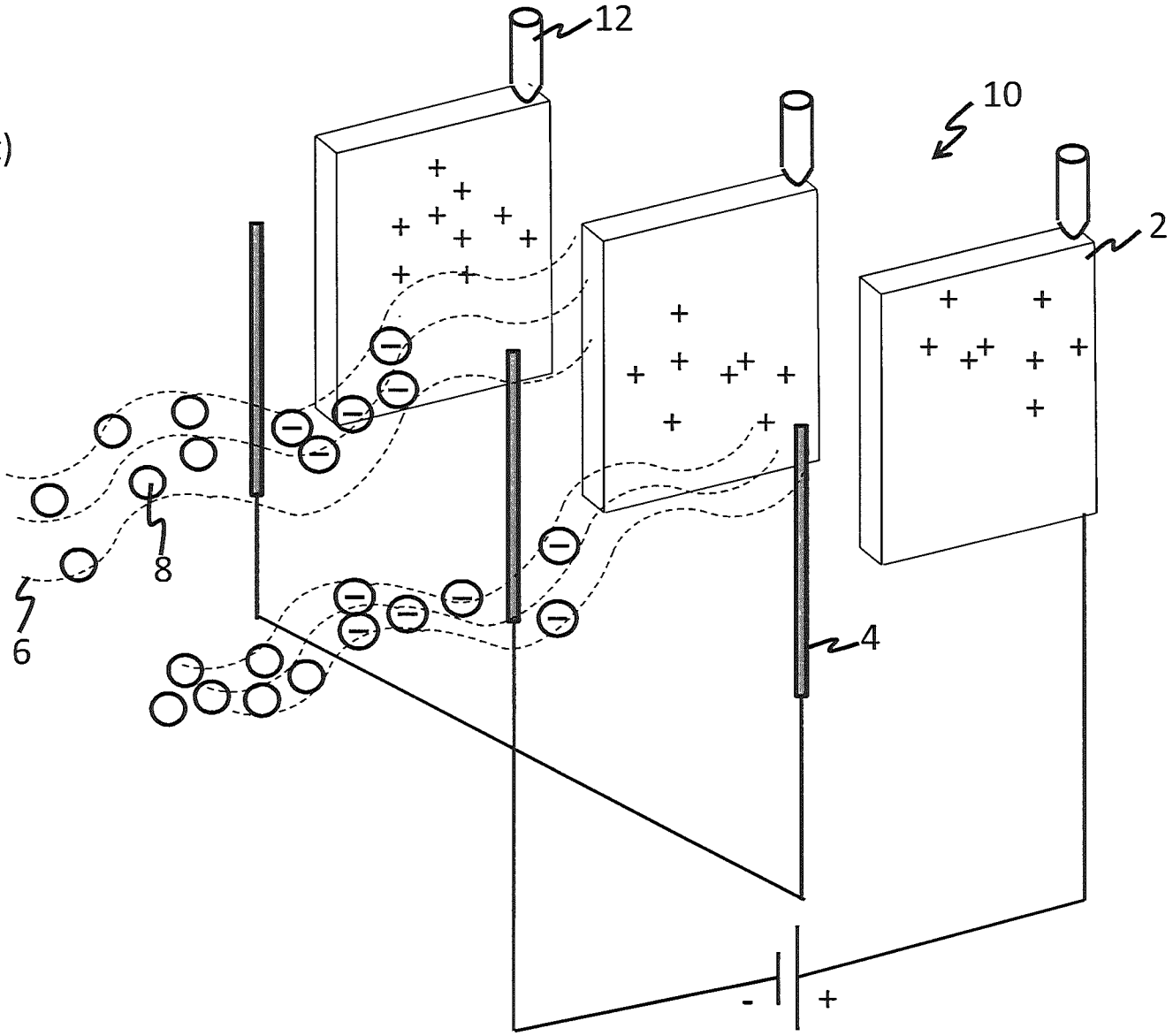
Figure 1 (Prior Art)
FIG. 1 is an exemplary schematic diagram of a prior art electrostatic precipitator 10.
Figure 2:
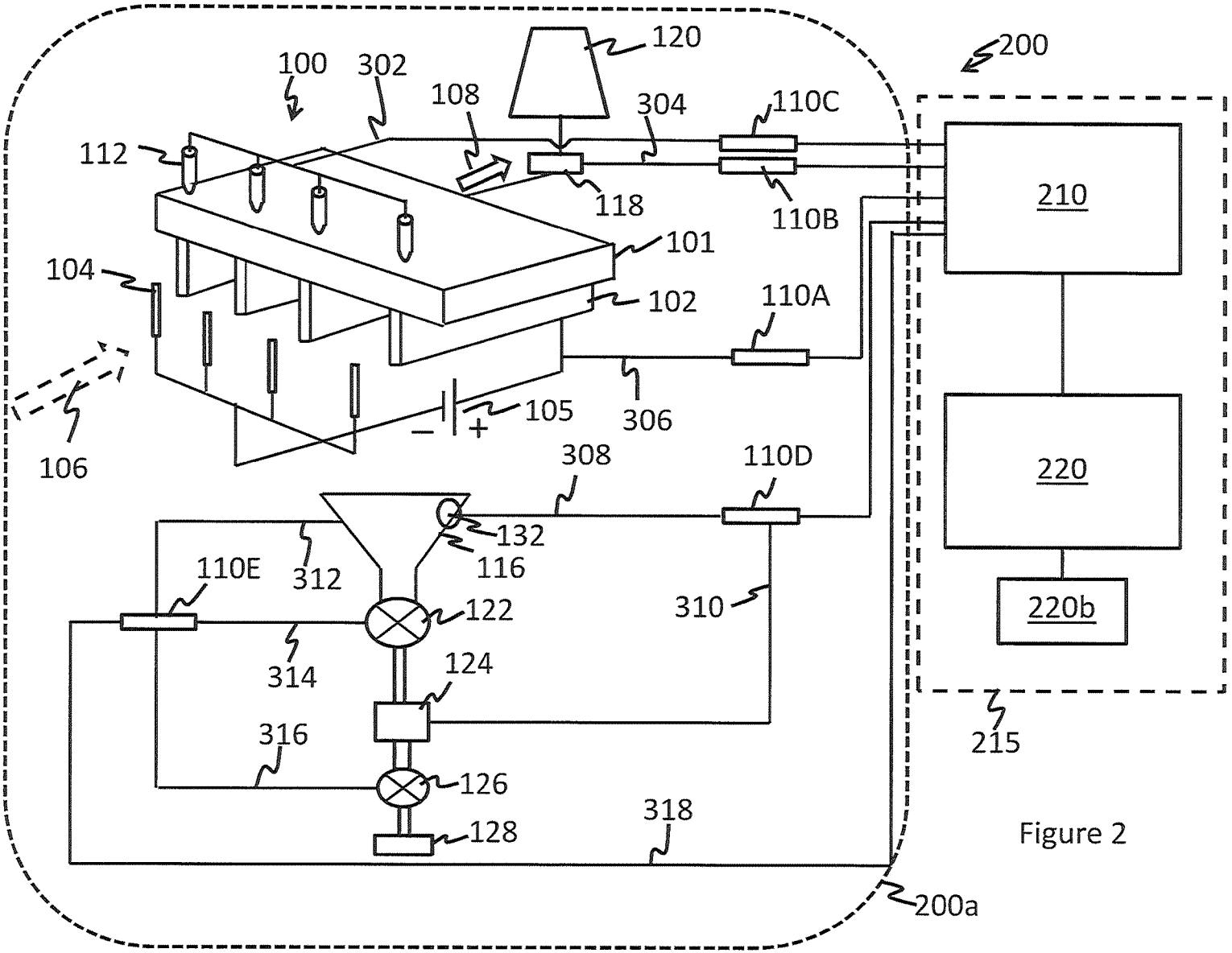
FIG. 2 is an exemplary schematic diagram of the system 200 for data capture and control of an electrostatic precipitator 100.

With reference to the FIG. 2, disclosed herein is an electrostatic precipitator data capture and control system (hereinafter simply referred to as the "system") 200 and an electrostatic precipitator control process (hereinafter simply referred to as the "process" or the "method") that uses the system 200 for data capture and control of the operational performance and emissions from one or more associated electrostatic precipitators 100. As such, the system 200 comprises an electrostatic precipitator 100 that is in operative communication with a computer control system 215. The computer control system 215 comprises a controller 210 and a computer 220. The computer 220 comprises a display monitor **220*b*. While the FIG. 2 depicts the controller 210 and the computer 220 as being separate pieces of equipment, they can be merged into a single unit. The computer 220 is programmable and the controller 210 is programmable via the computer 220**.

The term "operative communication" can include electrical communication, optical communication, electromagnetic communication, mechanical communication, fluid or pneumatic communication, or combinations thereof. Electrical communication, optical communication, electromagnetic communication, or a combination thereof, are preferred. Communication transmissions between the computer 220, the controller 210 and the various parts of the electrostatic precipitator 100 can be conducted with, for example, hardwiring, a wireless cellular network, a wireless local area network (WLAN) or Wi-Fi network, a Third Generation (3G) mobile telecommunications network, a private network such as an intranet, a public network such as the Internet, or some combination thereof, hereinafter referred to in general as the "network".

The system 200 is operable to manipulate operating parameters of the associated electrostatic precipitator 100 based on data captured as to the operational performance of the electrostatic precipitator 100 to improve the performance thereof. The system 200 is operable for user viewing of data captured as to the operational performance of the electrostatic precipitator 100 from any one or more associated computers 220. One or more associated computers 220 may be used to view on an associated display monitor 220*b* the data captured, since a network connection may be used for operative communication with any other computer that is connected thereto via the network. This permits user monitoring of operational performance data captured on the electrostatic precipitator 100 from any remote point inside or outside of a plant or facility 200*a* in which the electrostatic precipitator 100 is located.

The display monitor 220*b* can also be used to view the operational performance of the controller 210. In other words, the display monitor 220*b* can be used to view the controller's 210 adjustments to system 200 based on signal transmissions received by the controller 210 from the computer 220. In an embodiment, the computer 220 is programmed to initiate the controller's 210 adjustments to system 200 based on the data captured and received by the computer 220.

As will be seen below, various operative components of the system 200 are in operative communication with the computer 220 and the controller 210. Operative communication between various operative components of system 200 with the computer 220 and the controller 210 may as an option include multiplexers 110A, 110B, 110C, 110D and 110E. The multiplexers 110A, 110B, 110C, 110D and 110E are data capture selectors that select one of several analog or digital input signals and forward the selected input signals to the computer 220 and the controller 210. The multiplexers 110A, 110B, 110C, 110D and 110E increase the amount of data capture that can be sent over the network within a certain amount of time and bandwidth.

With reference once again to the FIG. 2, the electrostatic precipitator 100 comprises a housing 101 that comprises a plurality of electrically grounded vertical plates 102 and a plurality of metallic wire electrodes 104 disposed upstream of the electrically grounded vertical plates 102. The electrically grounded vertical plates 102 and the plurality of metallic wire electrodes 104 are in operative communication with a power supply 105 that maintains the metallic wire electrodes 104 at a high negative potential with respect to the electrically grounded vertical plates 102. The power supply 105 is in operative communication with the computer 220 and the controller 210 via an optional multiplexer 110A. Data captured such as the current (mA), voltage (V) and power (W) used in the electrostatic precipitator 100 is transmitted to the computer 220 and the controller 210 via operative communication 306.

The electrostatic precipitator 100 is in fluid communication with a stack 120 arranged downstream of the electrostatic precipitator 100. Disposed downstream of the electrostatic precipitator 100 and upstream of the stack 120 is a measuring device 118 that measures the particulate matter content of a flue gas 108 that has been treated by passage through the electrostatic precipitator 100. Measuring device 118 obtains a particulate matter content measurement of the flue gas 108 in contact therewith. In some embodiments, the measuring device 118 is an optical device that measures the opacity of the flue gas 108 that has been treated by passage through the electrostatic precipitator 100 to obtain an opacity measurement. Data capture of opacity measurements of the flue gas 108 correlates to the particulate matter removal efficiency of the electrostatic precipitator 100. The measuring device 118 may be a mass flow meter, an optical device, a chemical analyzer, such as, for example, an infrared analyzer or a mass spectrometer, or a combination thereof. In some embodiments, the measuring device 118 may comprise two or more of the mass flow meter, the optical device, and the chemical analyzer. The measuring device 118 is in operative communication with the computer 220 and the controller 210. Measuring device's 118 operative communications with the computer 220 and the controller 210 may optionally include multiplexer 110B. Data captured as to the condition of the flue gas, e.g., the amount of particulate matter in the flue gas stream and/or the chemical content of the flue gas stream, is transmitted to the controller 210 and to the computer 220 via operative communication 304.

The electrostatic precipitator 100 further comprises a plurality of rappers 112 (hereinafter rappers 112) that are operative to dislodge particulate matter caked on the electrically grounded vertical plates 102. The rappers 112 are part of a rapper system 400 that is detailed below with respect to the FIG. 3. Rappers 112 transmit a shearing force to the electrically grounded vertical plates 102 in order to dislodge deposited particulate matter therefrom. The rappers 112 are also in operative communication with the computer 220 and the controller 210. The rappers' 112 operative communication with the computer 220 and the controller 210 may optionally include multiplexer 110C.

Figure 3:
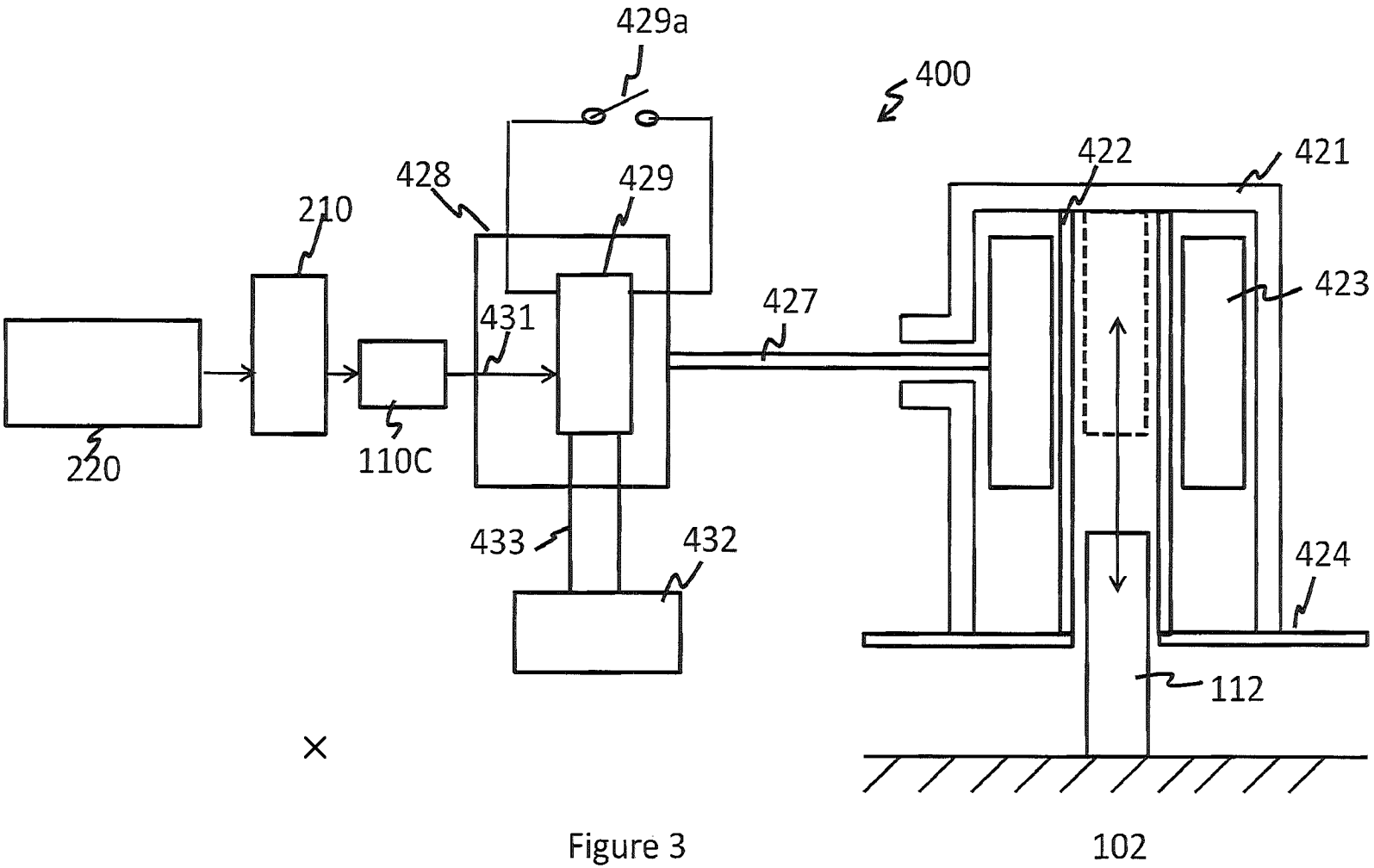
FIG. 3 is an exemplary schematic diagram of the rapper system 400 used in the electrostatic precipitator 100.

FIG. 3 is a depiction of one embodiment of a rapper system 400 useful for operating the rappers 112 and for cleaning the electrically grounded vertical plates 102 in the electrostatic precipitator 100. The rapper system 400 comprises a large electrical coil 423 that, when energized, vertically lifts the rappers 112. The rappers 112 are in the form of large metal cylinders.

The rapper system 400 comprises a housing 421 for the rappers 112, guides 422 for the rappers 112 and a mounting 424 for the housing 421 arranged a set distance from the vertical plates 102 to be cleaned. A coil energizer 428 via operative communication 427 supplies the electrical coil 423 with electric energy. In an embodiment, the electric energy is provided via electric pulses for vertically moving the rappers 112 inside the guides 422. When the electrical coil 423 is energized with electrical energy from the coil energizer 428, particularly when an electric current flows through the electrical coil 423, the rappers 112 are vertically moved due to the magnetic force caused by the electrical coil 423.

The coil energizer 428 comprises a pulse generator 429 which is in operative communication with the computer 220 and the controller 210. A power source 432 for supplying the electrical coil 423 with electric energy is connected with the pulse generator 429 by a wire connection 433.

The pulse generator 429 generates pulses from the electric energy supplied by the power source 432. In this embodiment the pulse generator 429 is operated by DC current and the polarities of the initial electrical pulse and the additional electrical pulse are equal. In other embodiments it might be desirable to operate with AC current and to switch polarities of the initial electrical pulse and additional electrical pulses. In this case the pulse generator 429 can optionally comprise a switch 429*a* for switching the polarity of the generated pulses. Because of the changing of magnetization of the rappers 112, a period of demagnetization occurs after each polarity shift. An integral of forces applied to the rappers 112 will then be smaller than without the changing of magnetization of the rappers 112.

The controller 210 generates control signals 431 that are transmitted to the pulse generator 429 in order to adjust the intensity and the duration of the initial electrical pulse and any additional electrical pulses depending on the desired cleaning capacity.

The computer 220 via the controller 210 generates control signals for controlling the coil energizer 428, particularly the generation of electric pulses. Optionally, a multiplexer 110C is provided between the controller 210 and the pulse generator 429. As noted above, the multiplexer 110C increases the amount of data captured that can be transmitted from the computer 220 and the controller 210 to the pulse generator 429, and vice versa. Especially in applications where a plurality of rappers 112 are mounted on the electrostatic precipitator 100, the computer 220 controls the appropriate functioning and synchronization of this plurality of rappers 112. Further details of the operation of the rapper system 400 with control provided by the computer 220 and the controller 210 will be detailed below when operation methods of the electrostatic precipitator 100 are discussed.

With reference now once again to the FIG. 2, arranged vertically below the electrostatic precipitator 100 is a hopper 116 that is operative to collect ash and particulate matter dislodged from the electrostatic precipitator 100. Arranged vertically below the hopper 116 is a first feeder valve 122, a feeder 124, a second feeder valve 126, and an ash exhaust 128. A temperature probe 132 is disposed in the hopper 116 to measure the temperature of the ash discharged from the electrostatic precipitator 100 to obtain temperature measurements thereof.

The data captured regarding temperature measurements measured by the temperature probe 132 in the hopper 116 and the feeder 124 are transmitted via operative communications 308 and 310 to the computer 220 and the controller 210. Transmissions from the temperature probe 132 to the controller 210 and the computer 220 may optionally include multiplexer 110D. These temperature measurements are utilized in the computer 220 to provide control via controller 210 for proper functioning of the rapper system 400 and to correlate data captured as to potential sparking in the electrostatic precipitator 100. Control signals from the computer 220 and the controller 210 are transmitted via operative communications 314 and 316 to the first feeder valve 122 and the second feeder valve 126 respectively. The data captured regarding the operational functioning of the first feeder valve 122 and the second feeder valve 124 is transmitted to the computer 220 and the controller 210. Data captured regarding the operational functioning of the first feeder valve 122 and the second feeder valve 124 transmitted to the computer 220 and the controller 210 may optionally include transmission through the multiplexer 110E. Data captured as to the amount or level of ash and particulate matter in flue gas stream 106 and the rate of deposition of ash and particulate matter in the hopper 116 are transmitted to the computer 220 and the controller 210 via operative communication 312.

In an embodiment, data captured pertaining to the power supplied to the electrically grounded vertical plates 102 and plurality of metallic electrodes 104 transmitted via operative communication 306 may be correlated with data captured from the rappers 112 transmitted via operative communication 302, data captured from measuring device 118 transmitted via operative communication 304 and/or data captured from the hopper 116 transmitted via operative communications 310, 312, 314, 316 and 320, for use by computer 220 to predict the occurrence of sparks in the electrostatic precipitator 100. As such, computer 220 receives the data captured and transmits signals for system 200 adjustments made via the controller 210 to prevent the occurrence of sparking in the electrostatic precipitator 100. In an embodiment, the computer 220 can use data captured from the rappers 112, the measuring device 118, or the hopper 116, to predict the occurrence of sparks in the electrostatic precipitator 100. Alternatively, the computer 220 can correlate data captured from two or more of the measuring devices 118, the rappers 112 and the hopper 116 to predict the occurrence of sparks in the electrostatic precipitator 100.

In one embodiment, in one method of operating the electrostatic precipitator 100, when the flue gas stream 106 generated by the combustion of carbonaceous fuel is discharged to the electrostatic precipitator 100, the flue gas stream 106 travels from the metallic wire electrodes 104 towards the electrically grounded vertical plates 102. The computer 220 and controller 210 transmit signals to the electrostatic precipitator power supply 105 that an applied voltage of several thousand volts is to be supplied between the metallic wire electrodes 104 and the electrically grounded vertical plates 102, which causes a corona discharge that ionizes the flue gas stream 106 around the metallic wire electrodes 104. Data captured about the applied current and the voltage transmitted via operative communication 306 is received and recorded by the computer 220.

The generated ions adhere to the particulate matter present in the flue gas stream 106, thereby charging the particulate matter causing the charged particulate matter to migrate towards the electrically grounded vertical plates 102. The charged particulate matter collects on and builds up on the electrically grounded vertical plates 102 forming a layer of particulate matter on the vertical plates 102.

When the layer of particulate matter on the electrically grounded vertical plates 102 exceeds a certain desired thickness, the controller 210 directs the rapper system 400 to activate the rappers 112 to impact the electrically grounded vertical plates 102 causing the collected layer of particulate matter to dislodge and fall into a hopper 116 located vertically below the electrostatic precipitator 100. Data captured as to the frequency of deployment of the rappers 112 is transmitted via operative communication 302 to the computer 220.

After the removal of particulate matter from the flue gas stream 106, the flue gas 108 (now devoid of particulate matter) passes through to the stack 120 and is discharged to the atmosphere. As the flue gas 108 exits the stack 120 it passes the measuring device 118 where its opacity, mass flow rate or chemical composition is measured to obtain measurements thereof. The measuring device 118 detects the type and measures the amount of particulate matter in the flue gas stream 106, as well as measuring the rate of change in the amount of particulate matter being discharged in the flue gas stream 106. The rate of change in the amount of particulate matter discharged in the flue gas stream 106 is indicative of the type of particulate matter and can be correlated to the performance of the electrostatic precipitator 100, as well as to the voltage applied between the metallic wire electrodes 104 and the electrically grounded vertical plates 102. Data captured and transmitted via operative communication 304 gathered from the measuring device 118 can be correlated with data captured and transmitted via operative communication 306 obtained from the power supply 105 or with the data captured and transmitted via operative communication 302 obtained from the rapper 112. Similarly, data captured and transmitted via operative communications 310, 312, 314, 316 and 320 received from the hopper 116 may be correlated with the data captured and transmitted via operative communications 304, 306 and 308 obtained from the measuring device 118, the power supply 105 and with the rapper 112 respectively. The computer 220 can be used to generate these correlations and to predict when sparking in the electrostatic precipitator may occur. The computer 220 can then signal the controller 210 to initiate changes to adjust operating conditions to avoid sparking in the electrostatic precipitator 100.

The computer 220 thus receives and records data captured on electrical power supply to the electrostatic precipitator 100, spark rate across electrodes 104 and 102, functioning and the frequency of functioning of the rappers 112, temperature measurements from the hopper 116, measurements of the amount of dust in the hopper 116, functioning of the first and second feeder valves 122 and 124 in the hopper 116, opacity measurements of the flue gas 108 leaving the electrostatic precipitator 100, mass flow of particulates leaving the electrostatic precipitator 100, chemical composition of the particulate matter in the flue gas 108 leaving the electrostatic precipitator 100, and the like. The computer 220 provides a visual display on display monitor 220*b* of the signals transmitted through the operative communications 302, 304, 306, 308, 310, 312, 314, 316 and 318, and optionally, through multiplexers 110A, 110B, 110C, 110D and 110E, on a real time basis or on an intermittent stored data capture basis. The computer 220 receives and logs data captured, checks data captured against predetermined system limits, generates alarms, generates periodic system reports, and generates operation performance data for the various components of the system 200 detailed above. The computer 220 has a display monitor 220*b* that provides a continuous visual display of data for use by the user and allows for enhanced data capture extraction.

The system 200 and the method of operation for the system 200 disclosed herein facilitates continuous data capture under full operating conditions. In addition, the computer 220 of system 200 continuously receives data captured relative to the performance of the electrostatic precipitator 100 and can therefore quickly identify a system malfunction and its causes by data captured outside of predetermined system limits. Since data captured from the system 200 is continuously transmitted to the computer 220 and since data captured on the performance of the system 200 is continuously visually displayed on a display monitor 220*b* for the user, advance warning signals by the computer 220 can reduce system 200 maintenance as well as the amount of expertise needed to analyze problems with system 200. The computer 220 may also be used to automatically requisition parts used for repair of the electrostatic precipitator 100 and its components prior to disassembly for repair or maintenance thereof.

The controller 210 is responsive to all computer 220 command signals and according thereto adjusts the operation of the various system components for optimum overall performance thereof. The computer 220 may use real-time data captured for signals transmitted to the controller 210, or use historical data captured, received and stored by the computer 220 for signals transmitted to the controller 210 to adjust the power supplied to the electrostatic precipitator 100 from the power supply 105, the frequency of deployment of the rappers 112, and the frequency of control of the first and second valves 122 and 126 in the hopper 116. In an embodiment, the computer 220 may signal the controller 210 to automatically adjust operational performance of the electrostatic precipitator 100 based on previous collected data capture records, historical system adjustments or based upon preprogrammed mathematical functions.

In an embodiment, data captured and received by the computer 220 is used for a type of triggering event such as a parameter adjustment or when the generation of a particular type of spark is predicted to occur. Spark control and avoidance is an important feature of maintaining an electrostatic precipitator 100 in working condition during its life cycle.

With reference now once again to the FIG. 2, in an electrostatic precipitator 100, the power, and hence the voltage (V) used to achieve a certain desired efficiency in the removal of particulate matter from the flue gas stream 106 is lower at a higher flue gas temperature, than at a lower flue gas temperature. The voltage V is applied between the plurality of metal wire electrodes 104 and the electrically grounded vertical plates 102. Thus, for example, a voltage V1, which is used to obtain 60% particulate matter removal efficiency at a first temperature T1, is higher than a voltage V2 which is used to obtain that same removal efficiency at a second temperature T2, which is higher than the first temperature T1. In short, the voltage varies inversely with temperature for a given particulate removal efficiency from the flue gas stream 106 in the electrostatic precipitator 100.

The removal of particulate matter in the electrostatic precipitator 100 depends, among other things, on the extent of the electrical corona generated around the plurality of metal wire electrodes 104, in the FIG. 2. A certain removal efficiency of particulate matter corresponds to a certain magnitude of the corona generated around the plurality of metal wire electrodes 104. One possible explanation for this behavior is that the voltage used to generate a corona of a certain magnitude at a relatively high flue gas temperature is lower than the voltage used to generate a corona of that same magnitude at a relatively low flue gas temperature. The temperature of the flue gas stream 106 and the voltage applied can therefore be controlled to prevent or to reduce spark generation in the electrostatic precipitator 100.

In an embodiment, the temperature probe 132 that measures temperature in the hopper 116 to obtain temperature measurements thereof can be used as a predictor of sparking conditions. The greater the flue gas temperature measurements, the greater is the temperature of particulate matter and ash collected in the hopper 116 as measured by the temperature probe 132. The hopper 116 temperature measurements can thus be used in conjunction with the voltage to determine the amount of particulate matter that is being collected from the flue gas stream 106 in the electrostatic precipitator 100. Historical data capture stored in the computer 220 may be used to determine a hopper temperature-voltage relationship where sparking occurs. If the existing conditions in the hopper and the applied voltage begin to resemble those historical conditions at which sparking occurs in the electrostatic precipitator 100, then the computer 220 directs the controller 210 to reduce the voltage applied between the plurality of metal wire electrodes 104 and the electrically grounded vertical plates 102 to a value at which the sparking conditions are abated. After the sparking conditions are abated, the voltage may be increased by the controller 210 to the normal operating value.

In another embodiment pertaining to spark control, the computer 220 receives data captured as to the voltage V and spark rate signals from the rapper system 400. This data captured may be observed on the computer 220 display monitor 220*b*. When the electrostatic precipitator 100 is operating at conditions that have historically produced sparks, the computer 220 can detect the condition and direct the controller 210 to deploy the rappers 112 more frequently. In other words, a frequency of rapper 112 deployment may be increased to remove caked particulate matter from the electrically grounded vertical plates 102 thus reducing the rate of spark generation.

In yet another embodiment, the opacity measurement from the flue gas stream 106 may be measured by the measuring device 118 and transmitted to the computer 220. The opacity measurement of the flue gas 108 exiting from an electrostatic precipitator 100 is a measure of the efficiency of the electrostatic precipitator 100 in removing particulate matter from the flue gas stream 106 entering the electrostatic precipitator 100. In order to measure the opacity of the flue gas 108, the measuring device 118 must comprise an optical device for measuring flue gas 108 opacity to obtain an opacity measurement.

The measuring device 118 which in this case is an optical device is exposed to the flue gas 108 exiting the electrostatic precipitator 100 to measure the opacity of the flue gas 108. The opacity measurement from the measuring device 118 is transmitted to computer 220 for comparison with predetermined high and low opacity measurement limits that define the desired opacity measurement range for the flue gas 108. If the opacity measurement of the flue gas 108 exceeds the high opacity measurement limit, the controller 210 directs the power supply 105 to increase the electric power supplied to the corona-generating metallic wire electrodes 104. If the opacity measurement level of the flue gas 108 falls below the low opacity measurement limit, the electric power supplied to the metallic wire electrodes 104 by the power supply 105 is reduced.

The computer 220 can therefore correlate data capture from the various components of the electrostatic precipitator 100 and generate a probability for the occurrence of a spark in the electrostatic precipitator 100. For example, the computer 220 may correlate the opacity measurement of the flue gas 108 after treatment by passage through the electrostatic precipitator 100, with the ash temperature measurement measured in the hopper 116 to determine based on historical data, a probability (P) for a sparking condition. In another example, the computer 220 may correlate the ash temperature measurement measured in the hopper 116 and the voltage provided by the power supply 105 to determine the probability P for a sparking condition in the electrostatic precipitator 100. In yet another example, the computer 220 may correlate the opacity measurement of the flue gas 108 and the voltage provided by the power supply 105 to determine the probability P for a sparking condition in the electrostatic precipitator 100.

When the calculated probability P exceeds a certain value, such as for example greater than or equal to about 0.75, in an embodiment greater than or equal to about 0.85 and more in an embodiment greater than or equal to about 0.9, the computer 220 may signal the controller 210 to adjust the power to the power system 105, or alternatively activate the coils 423 of the rapper system 400 to adjust the frequency of rappers 112 deployment. Other system 200 adjustments may be made to prevent or reduce the occurrence of sparks in the electrostatic precipitator 100.

The system 200 detailed herein is advantageous for control of the electrostatic precipitator 100 from any location inside or outside of the plant or facility 200*a*. System 200 operational parameters and operational performance can be visually viewed on a display monitor 220*b* from any location inside or outside of the facility or plant 200*a*. The display monitor 220*b* can also be used to view real-time operational parameters and operational performance of the controller 210. In an embodiment, the system 200 may be used with a plurality of electrostatic precipitators 100 at a particular facility 200*a* or with a plurality of electrostatic precipitators 100 located across multiple plants or facilities 200*a*.

The system 200 and the method for controlling the system 200 disclosed herein are exemplified by the following non-limiting example.

EXAMPLE

Figure 4:
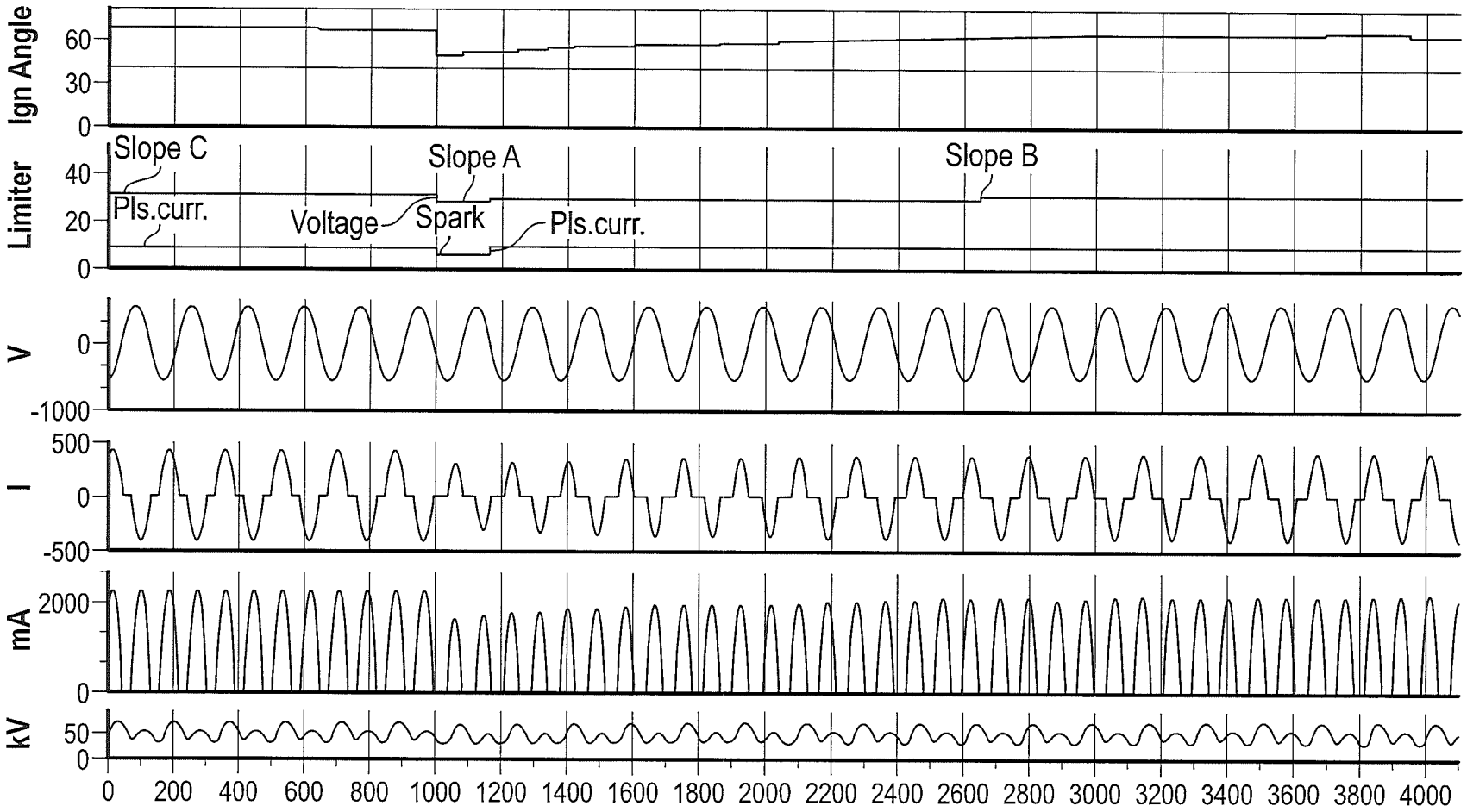
FIG. 4 is a graph illustrating operational performance of the electrostatic precipitator 100.

This example demonstrates data capture before, during, and after a double spark is produced in an electrostatic precipitator 100 transmitted and recorded by an online computer 220. FIG. 4 is a graph illustrating operational performance of the electrostatic precipitator 100. In FIG. 4, the voltage (kV) and current (mA) were used by the computer 220 to detect the spark which was quenched by not firing primary transistors for 2 pulses. The remaining time shows the controlled ramp back to full power for the electrostatic precipitator 100 after the spark was produced.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It is to be understood that while the disclosure has been described in conjunction with the preferred specific embodiments thereof, that the foregoing description as well as the examples, which follow are intended to illustrate and not limit the scope of the disclosure. Other aspects, advantages and modifications within the scope of the disclosure will be apparent to those skilled in the art to which the disclosure pertains.

What we claim is:

1. A system for controlling at least one electrostatic precipitator comprising:

a computer control system that comprises a computer and a controller in operative communication with the at least one electrostatic precipitator; and the computer control system operative to control performance of the at least one electrostatic precipitator by controlling one or more of:

a power supply that controls voltage between an electrically grounded vertical plate and a metallic wire electrode in the at least one electrostatic precipitator;

a first feeder valve and a second feeder valve in a hopper; and a power supply to an electrical coil in operative communication with a rapper, wherein the computer correlates an ash temperature measurement in the hopper and a voltage provided by the power supply to determine a sparking condition.

2. The system of claim 1, wherein the computer continuously receives signals from the power supply, the first feeder valve, the second feeder valve, a temperature probe disposed in the hopper, and a measuring device operative to measure an opacity of a flue gas stream, a chemical composition of the flue gas stream, or a mass flow of the flue gas stream.

3. The system of claim 1, wherein the computer is configured to obtain an opacity measurement of the flue gas stream and direct the power supply to control the voltage between the electrically grounded vertical and the metallic wire as a function of the opacity measurement, wherein the computer is configured to compare the opacity measurement to predetermined opacity measurement limits that define a desired opacity measurement range for the flue gas, wherein the computer directs the power supply to increase or decrease the voltage based on the comparison of the opacity measurement to the predetermined opacity measurement limits.

4. The system of claim 1, wherein the computer is configured to direct the power supply to control the voltage between the electrically grounded vertical and the metallic wire to achieve a desired efficiency in removal of particulate matter from the flue gas stream, wherein the computer directs the power supply to increase or decrease the voltage as a function of a temperature measurement obtained from the flue gas stream to achieve the desired efficiency in removal of particulate matter, wherein the increase or decrease to the voltage varies inversely with the temperature measurement.

5. The system of claim 1, wherein the computer control system provides a visual display of operational performance of the at least one electrostatic precipitator from a location inside or outside of a facility in which the at least one electrostatic precipitator is located, wherein the operational performance include one or more of voltage, current and power data associated with operating the at least one electrostatic precipitator.

6. The system of claim 2, wherein the computer is in operative communication with the power supply, the first feeder valve, the second feeder valve, the temperature probe, the measuring device, and the power supply to the electrical coil via a multiplexer.

7. The system of claim 1, wherein the controller is responsive to computer signals to control operation of the power supply, the first feeder valve, the second feeder valve, and the power supply to the electrical coil to reduce sparking.

8. The system of claim 7, wherein real-time data capture received by the computer or historical data capture collected and stored by the computer is used to signal the controller to adjust power supplied to the at least one electrostatic precipitator by the power supply, a frequency of deployment of the rapper, or a frequency of control of the first feeder valve and the second feeder valve in the hopper.

9. The system of claim 1, wherein the controller automatically adjusts performance of the at least one electrostatic precipitator based on collected data capture, historical system adjustments, programmed predetermined measurements or programmed mathematical functions.

10. The system of claim 1, wherein the computer is operative to detect a triggering event in the at least one electrostatic precipitator; and wherein the triggering event is a parameter change or a generation of a spark.

11. The system of claim 1, wherein the computer is operative to provide a complete record and a real time display of historical operating conditions for the system.

12. The system of claim 1, wherein the at least one electrostatic precipitator comprises a plurality of electrostatic precipitators.

13. The system of claim 1, where the computer identifies a malfunction in the system and automatically requisitions parts used for repair of the malfunction, prior to disassembly of the system.

14. A method for controlling an electrostatic precipitator comprising:

transmitting a signal from an electrostatic precipitator, a measuring device for determining flue gas particulate matter content, a rapper system having an electrical coil powered by a power supply, and a hopper associated with the electrostatic precipitator, to a computer control system, where the computer control system comprises a computer and a controller; and transmitting a signal from the computer to the controller for controller adjustment to the electrostatic precipitator based on historical data capture or based on correlations between transmitted signals, wherein the computer correlates an ash temperature measurement in the hopper and a voltage provided by the power supply to determine a sparking condition.

15. The method of claim 14, wherein the controller adjustment of the electrostatic precipitator prevents or reduces formation of sparks in the electrostatic precipitator.

16. The method of claim 14, further comprising directing the power supply to adjust the voltage between the electrically grounded vertical plate and the metallic wire electrode in response to determining the sparking condition.

17. The system of claim 1, wherein the computer directs the power supply to adjust the voltage between the electrically grounded vertical plate and the metallic wire electrode in response to determining the sparking condition.

* * * * *